US011786436B2

(12) United States Patent
Munton et al.

(10) Patent No.: US 11,786,436 B2
(45) Date of Patent: Oct. 17, 2023

(54) WALKER COMPRISING TOILET SEAT LIFTING MECHANISM

(71) Applicants: Nathan Munton, Wilmington, NC (US); Lauren Munton, Wilmington, NC (US)

(72) Inventors: Nathan Munton, Wilmington, NC (US); Lauren Munton, Wilmington, NC (US)

( * ) Notice: Subject to any disclaimer, the term of this patent is extended or adjusted under 35 U.S.C. 154(b) by 282 days.

(21) Appl. No.: 17/338,226

(22) Filed: Jun. 3, 2021

(65) Prior Publication Data

US 2021/0393471 A1 Dec. 23, 2021

Related U.S. Application Data

(60) Provisional application No. 63/046,558, filed on Jun. 30, 2020, provisional application No. 63/040,280, filed on Jun. 17, 2020.

(51) Int. Cl.
*A61H 3/04* (2006.01)
*A47K 13/10* (2006.01)

(52) U.S. Cl.
CPC ..... *A61H 3/04* (2013.01); *A47K 13/10* (2013.01); *A61H 2003/046* (2013.01); *A61H 2201/0161* (2013.01); *A61H 2201/1623* (2013.01); *A61H 2201/1676* (2013.01); *A61H 2203/0431* (2013.01)

(58) Field of Classification Search
CPC ..... A61H 3/04; A61H 2003/043; A61H 2003/046
See application file for complete search history.

(56) References Cited

U.S. PATENT DOCUMENTS

| | | | | |
|---|---|---|---|---|
| 3,038,174 | A * | 6/1962 | Brown | A61G 5/006 5/604 |
| 3,271,785 | A * | 9/1966 | Du Bose | A61G 5/1002 297/118 |
| 5,373,591 | A * | 12/1994 | Myers | A47K 3/122 4/578.1 |
| 6,371,142 | B1 * | 4/2002 | Battiston | A61H 3/04 135/66 |
| 8,480,100 | B2 * | 7/2013 | Staggs | A61G 5/1002 280/87.021 |
| 10,213,071 | B2 * | 2/2019 | Tao | A47C 4/10 |
| D882,051 | S * | 4/2020 | Armstrong | D23/299 |
| 11,129,506 | B2 * | 9/2021 | Grendel | A61H 3/0288 |
| 11,432,978 | B1 * | 9/2022 | Inkmann | A61H 3/04 |

(Continued)

*Primary Examiner* — Erez Gurari
(74) *Attorney, Agent, or Firm* — Ashley D. Johnson; Dogwood Patent and Trademark Law

(57) ABSTRACT

The presently disclosed subject matter is directed to a walker comprising a portable lift toilet seat. Particularly, the walker is defined by a frame that supports a toilet seat, a cover, and a pair of actuators. The cover provides a privacy feature, hiding the toilet seat from view during normal operation of the walker. When needed, the cover can be lifted or folded away to allow the user to access the toilet seat. The toilet seat can then be lifted and/or lowered by actuators positioned on either side of the walker. In this way, a user can easily be positioned over a toilet to use the bathroom without the need for a caregiver to lift and lower him. The user can also be lifted after they are done using the bathroom to return to a standing position or sitting position.

20 Claims, 14 Drawing Sheets

(56) References Cited

U.S. PATENT DOCUMENTS

| | | | | |
|---|---|---|---|---|
| 2011/0187067 | A1* | 8/2011 | Staggs | A61H 3/00 280/30 |
| 2012/0030867 | A1* | 2/2012 | Wang | A61H 3/04 4/237 |
| 2012/0205882 | A1* | 8/2012 | Staggs | A61G 5/1002 280/30 |
| 2015/0328069 | A1* | 11/2015 | Staggs | A61G 5/1037 4/604 |
| 2016/0106617 | A1* | 4/2016 | Wobith | A61G 5/1002 280/643 |
| 2016/0331610 | A1* | 11/2016 | Brown | A61G 5/14 |
| 2020/0268588 | A1* | 8/2020 | Desmarais | A61G 7/1049 |
| 2020/0352400 | A1* | 11/2020 | Grendel | A47K 11/04 |
| 2021/0137768 | A1* | 5/2021 | Buswell | A61B 5/112 |

* cited by examiner

WALKER COMPRISING TOILET SEAT LIFTING MECHANISM

CROSS-REFERENCE TO RELATED APPLICATIONS

This application claims priority to U.S. Provisional Patent Application No. 63/040,280 filed Jun. 17, 2020 and U.S. Provisional Patent Application No. 63/046,558 filed Jun. 30, 2021, the entire contents of which are hereby incorporated by reference.

TECHNICAL FIELD

The presently disclosed subject matter is generally directed to a walker comprising a mechanism that allows for the lifting and/or tilting of a toilet seat.

BACKGROUND

A large number of walkers are currently manufactured to improve the mobility of patients with certain physical disabilities, such as advanced age, arthritis, back pain, multiple sclerosis, Parkinson's disease, and the like. However, using the toilet still provides many challenges. Specifically, conventional toilet seats are characteristically low to the ground, making it very difficult for patients to use the toilet without the assistance of a nurse or family member. The patient must typically be lowered and lifted to/from the toilet seat. Often the patient is significantly heavier than the caregiver and cannot assist during the move. As a result, the caregiver can incur injury, such back strain, pulled muscles, sore joints, and the like. In addition, patients often move erratically while being moved and can slip out of the caregiver's grasp, increasing the likelihood of injury to the caregiver and/or dropping the patient. It would therefore be beneficial to provide a device that assists the patient when being lowered and raised from a toilet seat. It would further be beneficial if the device was available with a walker to allow the patient to use the lifting mechanism at any desired time.

SUMMARY

In some embodiments, the presently disclosed subject matter is directed to a walker comprising a structural frame, a seat assembly, and a pair of actuators. The seat assembly comprises a removable cover defined by a top surface and an interior, and a toilet seat positioned within the interior of the cover, wherein the toilet seat is hidden from view when the cover is in position but visible when the cover is removed. The actuators are functionally attached to the toilet seat, wherein each actuator comprises an arm that raises or lowers the toilet seat on demand.

In some embodiments, the frame comprises a pair of front legs, a pair of rear legs, a backrest, a pair of handles to guide the path of the walker, and a pair of brakes, each brake positioned adjacent to one of the handles.

In some embodiments, the frame further comprises a wheel positioned at one end of each of the front legs, each of the rear legs, or both.

In some embodiments, the frame is foldable.

In some embodiments, the toilet seat is releasably attached to the frame.

In some embodiments, the cover is pivotable about the frame or removable from the frame.

In some embodiments, each actuator comprises a hydraulic drive, pneumatic drive, gear drive, electric drive, motor drive, ion drive, gravity drive, threaded spindle drives, piezoelectric drive, recoil drive, gas spring, linear actuator, solenoids, pistons, or combinations thereof.

In some embodiments, the actuators are each powered by a rechargeable battery.

In some embodiments, the actuator arm can raise vertically or can raise at an angle to tilt the toilet seat.

In some embodiments, the toilet seat is tilted at an angle of about 30-85 degrees.

In some embodiments, the toilet seat is tilted such that a back end of the toilet seat is higher than a front end of the toilet seat.

In some embodiments, the actuator is attached to a base positioned on a lower face of the toilet seat.

In some embodiments, the walker further comprises one or more support arms that move in response to the raising of the actuator arm.

In some embodiments, the presently disclosed subject matter is directed to a method of lowering a user onto a toilet and raising the user from the toilet on demand. Particularly, the method comprises positioning the disclosed walker adjacent to a toilet, such that the walker toilet seat is above the toilet. The method includes removing or pivoting the cover to expose the toilet seat and positioning the user adjacent to the cover such that the rear side of the user contacts the toilet. The method comprises initiating the actuators to raise the toilet seat level with the user such that the user can contact the toilet seat, and then lowering the actuator arm to lower the user onto the toilet. When desired by the user, the actuator arms are initiated to raise the toilet seat, whereby the toilet seat is tilted to raise the user to a standing position.

DETAILED DESCRIPTION

Figure 1:
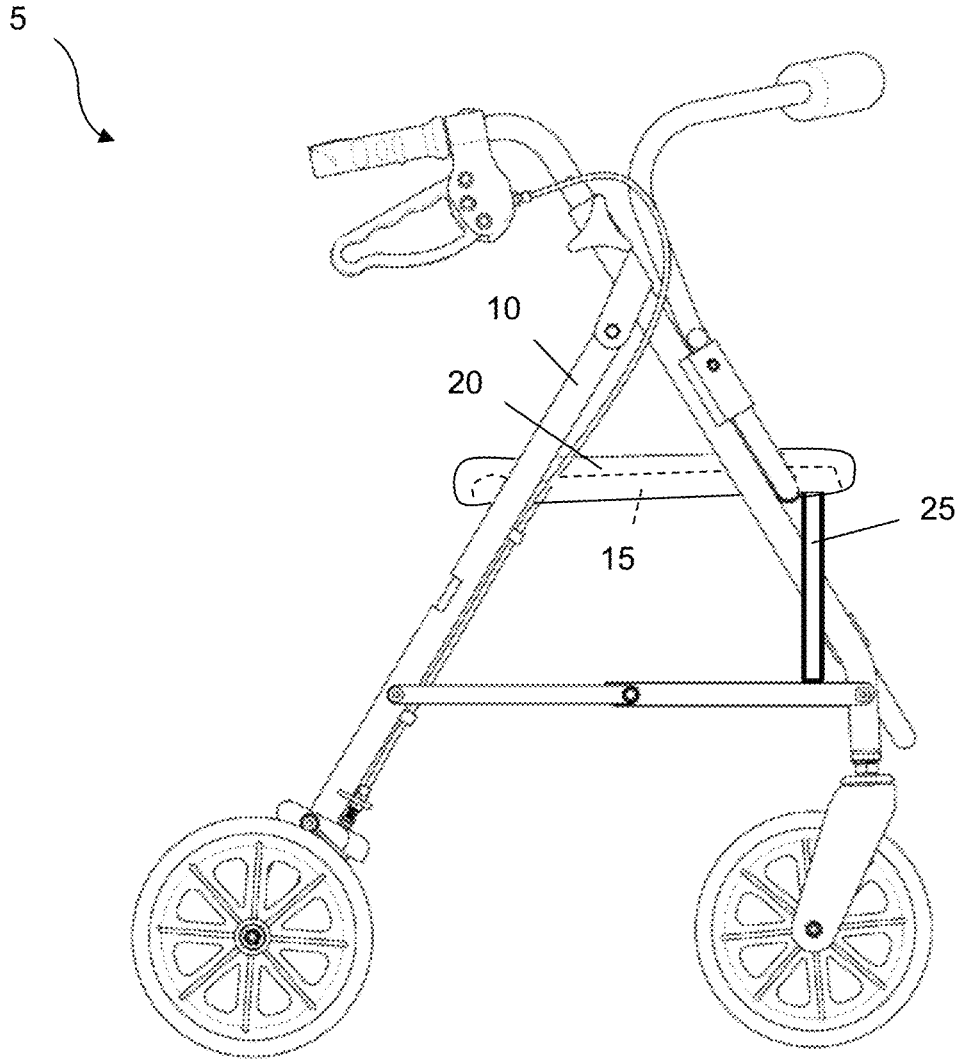
FIG. 1 is a side plan view of a walker in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is directed to a walker comprising a portable lift toilet seat. FIG. 1 illustrates one embodiment of walker 5 comprising frame 10 that supports toilet seat 15, cover 20, and actuators 25. The cover provides a privacy feature, hiding the toilet seat from view during normal operation of the walker. When needed, the cover can be lifted or folded away to allow the user to access the toilet seat. The toilet seat can then be lifted and/or lowered by actuators 20 positioned on either side of the walker. In this way, a user can easily be positioned over a toilet to use the bathroom without the need for a caregiver to lift and lower them. The user can also be lifted after they are finished using the bathroom to return to a standing position or sitting position. Walker 5 therefore includes a mechanism for lowering a toilet seat adjacent to a toilet bowl and raising the toilet seat via a tilted position to assist the user when using a toilet.

The term "walker" as used herein broadly refers to a device that assists a user when walking by providing a platform upon which the user can lean and steady their balance. In some embodiments, walker 5 can be configured as a rollator, which enables the patient to walk with the support of a frame, wheels, and a seat.

Figure 2:
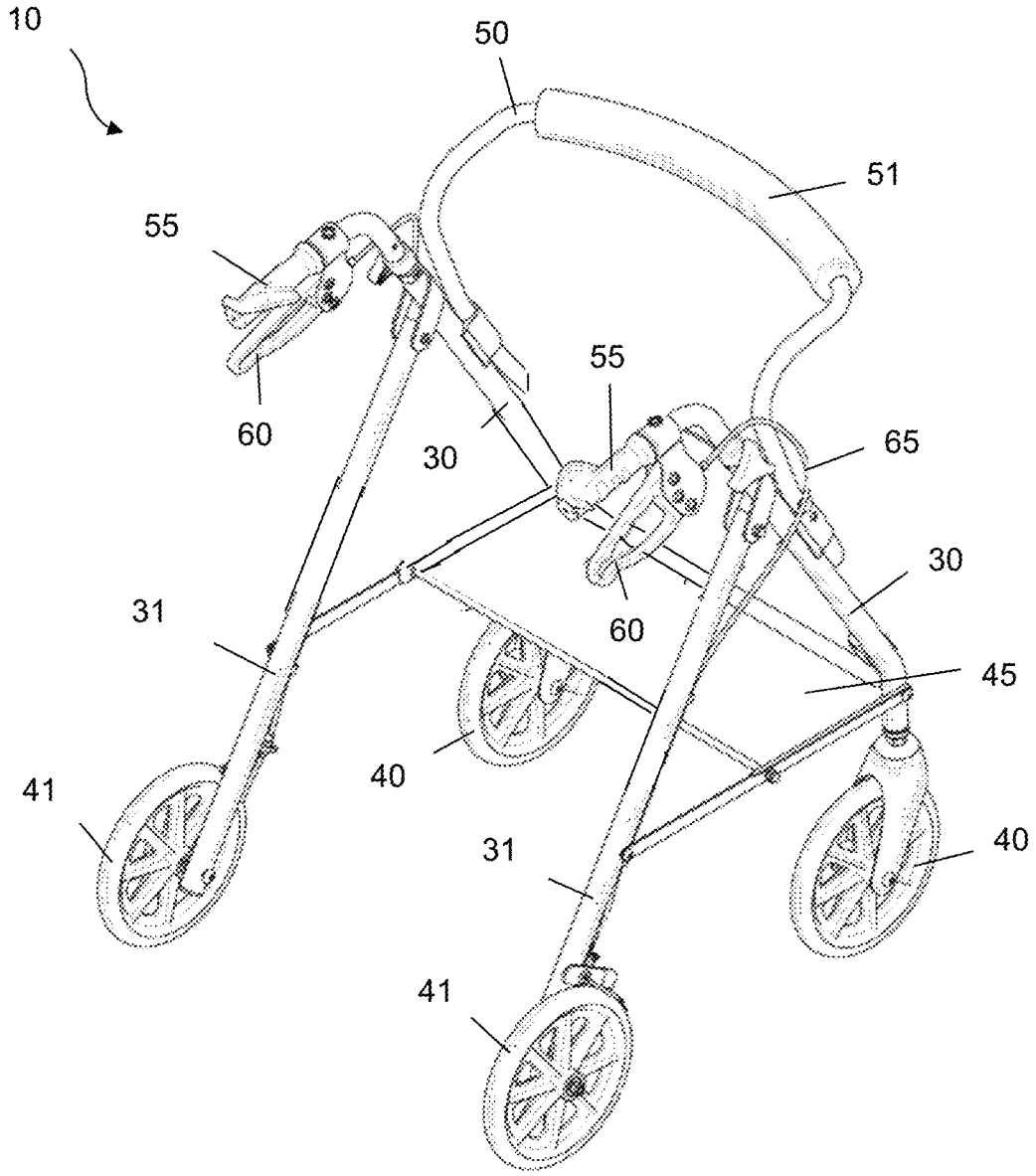
FIG. 2 is a perspective view of a walker frame in accordance with some embodiments of the presently disclosed subject matter.

FIG. 2 illustrates one representative example of walker frame 10 upon which a user can lean to obtain upper body support while walking. It should be appreciated that frame 10 can have any desired configuration that can support toilet seat 15 and cover 20 as described below. As shown, frame 10 includes a pair of front legs 30 and a pair of rear legs 31. The length of legs 30, 31 can be adjusted using any known mechanism to accommodate users of different heights. For example, in some embodiments each leg can include a telescoping feature to allow for lengthening and shortening. However, any known method of adjusting the length of the legs can be used.

Optionally, walker 5 can include a pair of front wheels 40 and a pair of rear wheels 41 attached to the bottom surface of each leg. The wheels can have any desired configuration, such as an inflated tire, a solid rubber material, or a plastic sphere. In some embodiments, the wheels are connected with a swivel device (e.g., caster-mounted) to enable the user to move in any direction immediately. In other embodiments, only front wheels 40 are configured to swivel, while rear wheels 41 are affixed in a forward-reverse direction. It should be appreciated that the presently disclosed subject matter also includes embodiments wherein the walker is configured with 2 wheels or without wheels.

The walker can include optional receptacle 45 to house and protect a patient's belongings (e.g., keys, books, snacks, etc.). Receptacle 45 can have any desired configuration such as (but not limited to) a tray, basket, drawer, shelf, and the like. In some embodiments, the receptacle is removable. In other embodiments, the receptacle is permanently mounted to the frame.

The walker can include backrest 50 that is used to support the weight of the user's back and/or provide a leaning surface when the user is seated. Backrest 50 can have any desired configuration, such as a curved rod mounted at the front of the walker frame. The backrest can include padding 51 to provide an added level of comfort to the user. Padding 51 can be constructed from any desired material, such as (but not limited to) fabric, memory foam, rubber, plastic, and the like. However, it should be appreciated that backrest and/or padding are optional features.

Walker 5 includes a pair of handles 55 supported by the frame that provide a surface for the patient to grasp when using the walker. The handles provide a gripping surface, allowing the user to steer the walker by pushing or pulling on the handles as needed. The handles can also aid in maintaining balance of the user when walking or standing. The height and/or angle of each handle 55 can be adjusted using any known mechanism. For example, a user-accessible telescoping feature can be used to adjust each handle, and a pushpin can be used to selectively lock the handle at a desired position. The hand grip portion of each handle can be straight or ergonomically designed. Further, the hand grip can be constructed from one or more non-slip materials, such as rubber, plastic, and the like.

As shown in FIG. 2, each handle 55 can include brake 60 positioned directly beneath for ease of use. However, the brake can be housed in any location. Brake 60 allows the user to have control over speed, positioning, and/or preventing the wheels from rolling. In some embodiments, brake 60 is controlled through cable 65 running down the side of frame 10 and coordinating with rear wheels 41. Grasping brake 60 can cause cable 65 to pull up on a pivoting member that causes a brake element to come into frictional contact with a corresponding wheel. The hand braking mechanism is well known in the art. It should be appreciated that the presently disclosed subject matter is not limited and any braking mechanism can be used to lock one or more wheels 40, 41 in place.

In some embodiments, each brake handle is independently operable and connected to a brake apparatus. In this way, the user can stop the walker using one or both hands.

Although not shown, it should be appreciated that additional accessories can be easily incorporated into walker frame 10. For example, optional footrests, drink holders, and/or arm cushions can be added.

Frame 10 can be constructed from any desired material. For example, suitable materials can include (but are not limited to) metal (e.g., steel, aluminum, titanium, stainless steel), plastic, carbon fiber, wood, or combinations thereof. The materials used to construct frame 10 should be able to withstand the weight of the user yet still remain lightweight.

Figure 3:
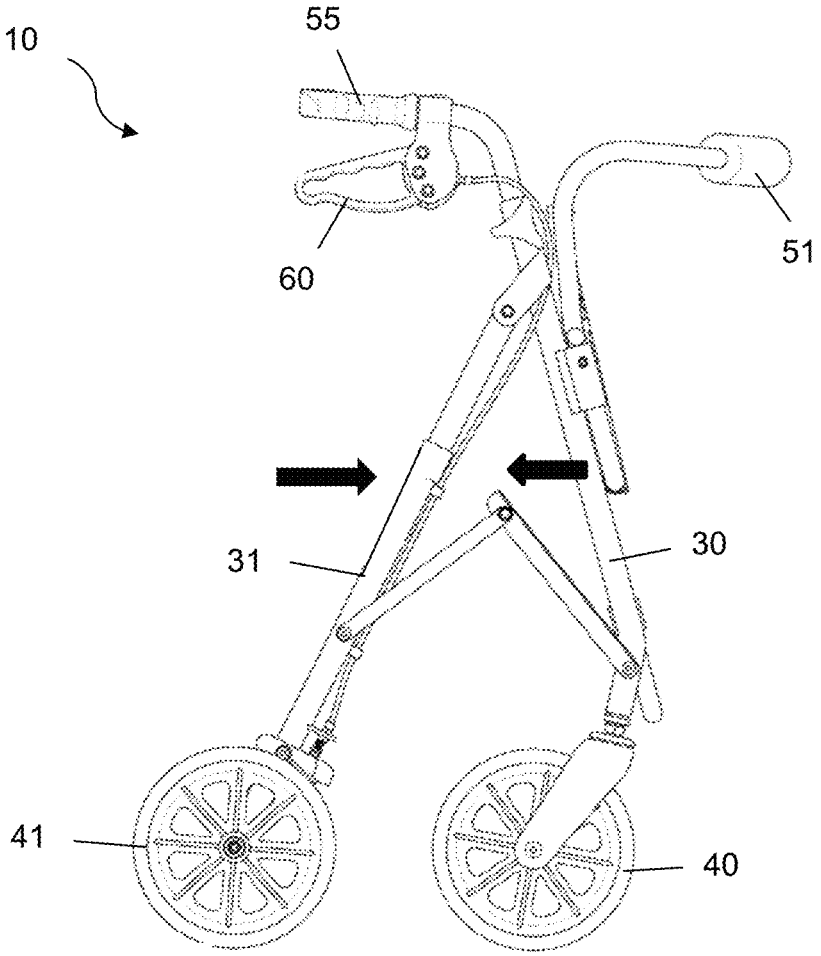
FIG. 3 is a side plan view of a walker frame being folded in accordance with some embodiments of the presently disclosed subject matter.

To accommodate ease of transport, the frame can be configured to fold about pivot points between an unfolded state and a folded state as shown in FIG. 3. In this way, the frame can be folded to a compact state to better facilitate storing the frame in a vehicle trunk or under a bed. However, the presently disclosed subject matter is not limited and includes embodiments wherein the use position does not fold to a storage position.

Figure 4A:
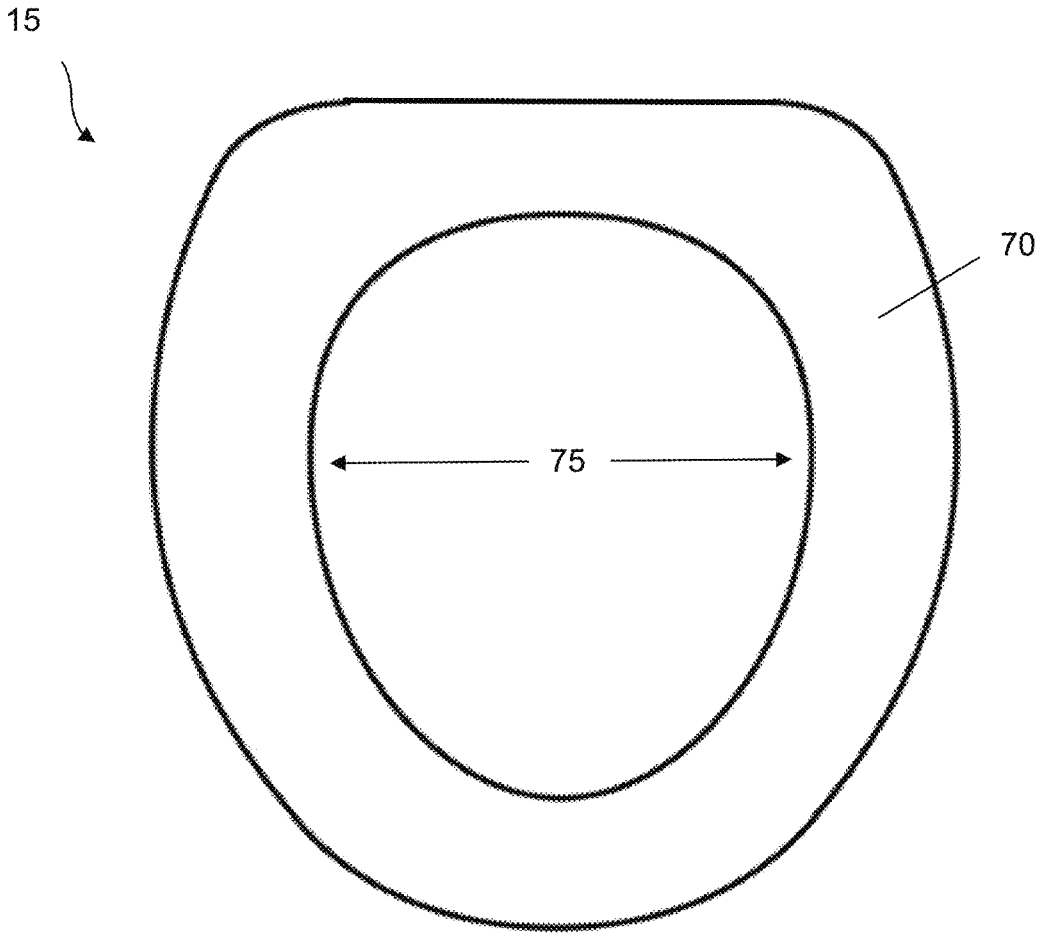
FIG. 4*a* is a top plan view of a toilet seat in accordance with some embodiments of the presently disclosed subject matter.

FIG. 4*a* illustrates one embodiment of toilet seat 15 that can be attached to the frame of walker 5. As shown, the toilet seat resembles a conventional toilet seat designed to rest on the rim of a toilet. The toilet seat can be configured as a substantially flat plate having top surface 70 that directly contacts the user's body when in use. The toilet seat also includes an opposing bottom surface. Central aperture 75 allows access to the interior of a toilet. Although rounded in shape in the figures, the sitting area and aperture can have any desired shape (e.g., circular, square, rectangular, abstract, triangular).

Figure 4B:
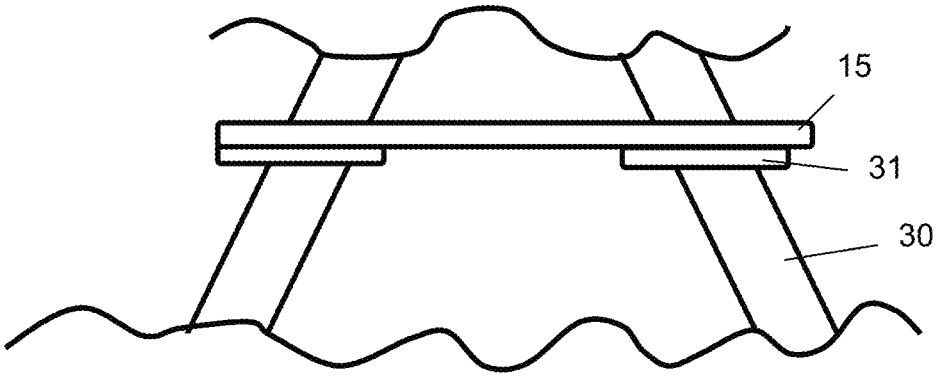
FIG. 4*b* is a fragmentary side plan view of a toilet seat supported on a walker frame in accordance with some embodiments of the presently disclosed subject matter.

Toilet seat 15 can be attached to frame 10 using any known method. For example, the walker frame can include one or more supports 31 that reinforce the toilet seat, as shown in FIG. 4*b*. Supports 31 can have any desired configuration, such as horizontal bars, ledges, braces, or any other elements that can support the weight of a toilet seat and user.

Any method of attaching the toilet seat to the supports can be used, such as (but not limited to) a snap fit arrangement, lock fit arrangement, magnets, hook and loop closure, clips, clamps, and/or mechanical elements (screws, bolts, etc.). In some embodiments, the toilet seat can be releasably attached to the frame to allow a user to remove the toilet seat for cleaning or replacement when needed. In other embodiments, the toilet seat is permanently affixed to the frame.

Figure 5A:
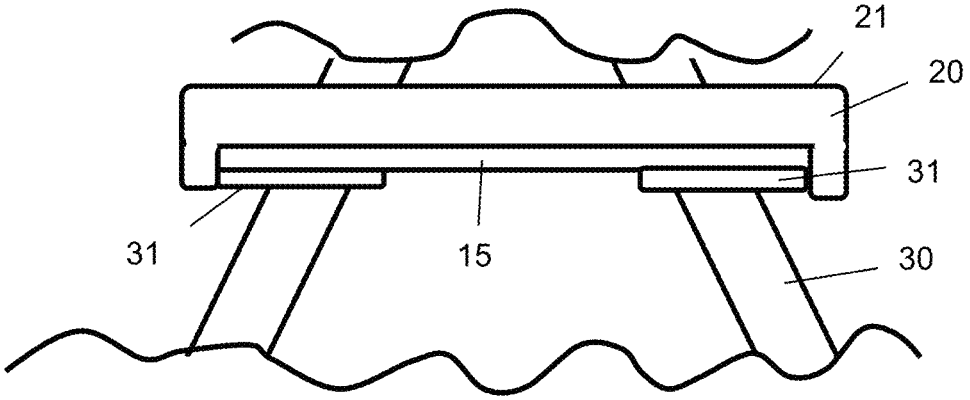
FIG. 5*a* is a fragmentary side plan view of a cover and toilet seat assembly in accordance with some embodiments of the presently disclosed subject matter.

As set forth above, walker 5 includes cover 20 that fits over and conceals toilet seat 15. As shown in FIG. 5*a*, cover 20 includes top surface 21 that directly contacts and supports the user's body when sitting. The cover can therefore be constructed from one or more soft or pliable materials to provide a comfortable seating surface for the user (e.g., when not using the bathroom). Suitable materials can include (but are not limited to) fabric, foam, padding, and the like.

Figure 5B:
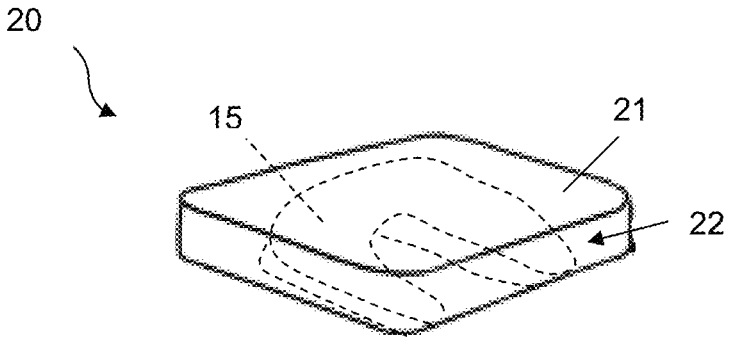
FIG. 5*b* is a perspective view of a cover comprising an internal toilet seat in accordance with some embodiments of the presently disclosed subject matter.
Figure 5C:
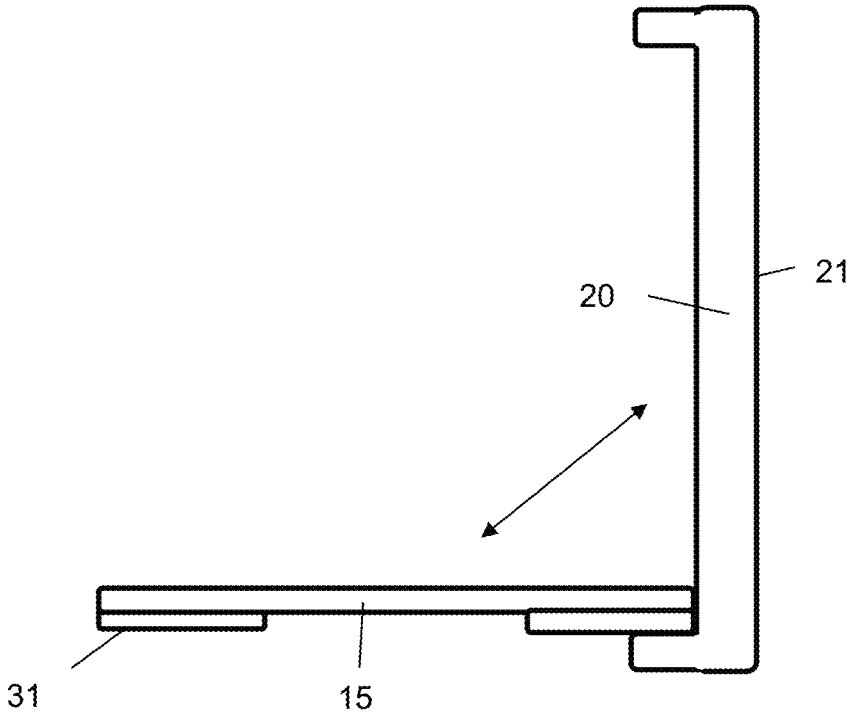
FIG. 5*c* is a side plan view of an assembly comprising a pivoted cover in accordance with some embodiments of the presently disclosed subject matter.

The cover further includes interior cavity 22 sized and shaped to house toilet seat 15, as illustrated in FIG. 5*b*. Cover 20 can lift up or be otherwise moved or removed to expose toilet seat 15 when needed. In some embodiments, the cover can be pivotally attached and constructed to flip behind the toilet seat, as shown in FIG. 5*c*. In such configurations, the flipped cover can be used as a comfortable backrest. Any known mechanism can be used to flip the cover, such as (but not limited to) the use of hinges. Cover 20 therefore can be moved between a stowed configuration (as shown in FIG. 5*a*) and a deployed configuration (as shown in FIG. 5*c*). In other embodiments, the cover can lift completely off the walker to expose the toilet seat.

The walker also includes a pair of actuators 25 that function to lift and lower the toilet seat. The term "actuator" refers to any mechanical element that can convert an input signal into physical motion to raise and lower toilet seat 15. The actuator can move the toilet seat using any known mechanism, such as a hydraulic drive, pneumatic drive, gear drive, electric drive, motor drive, ion drive, gravity drive, threaded spindle drives, piezoelectric drive, recoil drive, gas spring, linear actuator, solenoids, pistons, or combinations thereof.

Figure 6A:
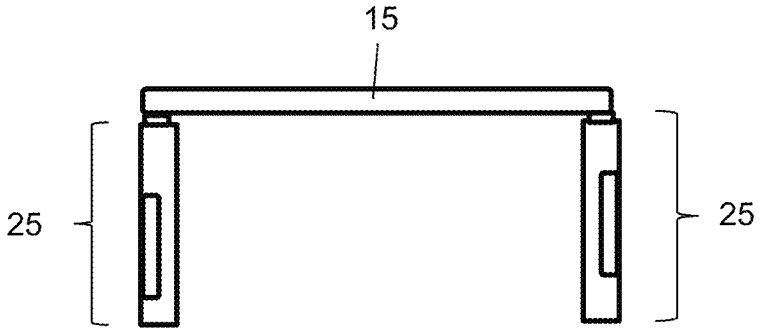
FIG. 6*a* is a front plan view of a toilet seat and two actuators in accordance with some embodiments of the presently disclosed subject matter.
Figure 6B:
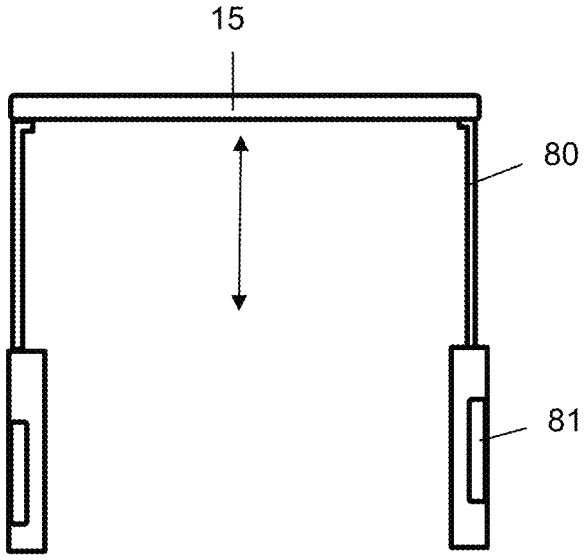
FIG. 6*b* is a front plan view of the toilet seat and actuators of FIG. 6*a* in use in accordance with some embodiments of the presently disclosed subject matter.

FIG. 6*a* illustrates one embodiment of actuators 25 positioned on either side of toilet seat 15 (e.g., the left and right hand sides of the walker). The actuators can be attached to the walker using any known mechanism (e.g., screws, bolts, clips magnets, etc.). Each actuator includes at least one arm 80 that raises the toilet seat as shown in FIG. 6*b*. Arm 80 can have any configuration, such as straight, curved, or jointed. In some embodiments, rechargeable battery pack 81 provides power to the actuator. However, any known method of providing power to the actuator can be used. When activated by the user, arms 80 can raise to lift and lower the toilet seat to a desired height. In this way, a patient can be raised or lowered before and after using the bathroom, as described in more detail below.

Figure 6C:
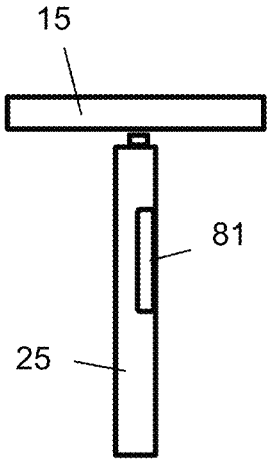
FIG. 6*c* is a side plan view of an actuator and toilet seat in accordance with some embodiments of the presently disclosed subject matter.
Figure 6D:
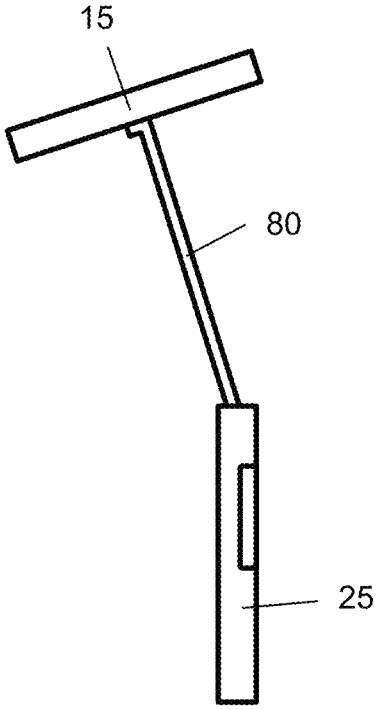
FIG. 6*d* is a side plan view of the actuator and toilet seat of FIG. 6*c* in use in accordance with some embodiments of the presently disclosed subject matter.
Figure 6E:
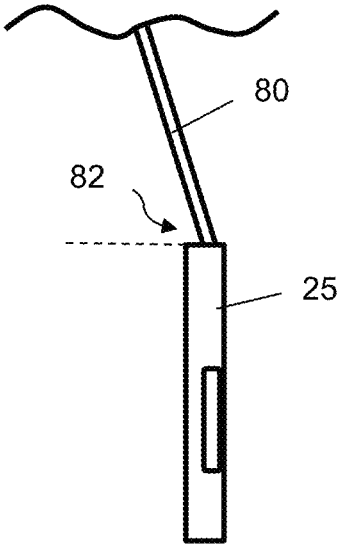
FIG. 6*e* is a fragmentary side plan view of an actuator arm in accordance with some embodiments of the presently disclosed subject matter.

In some embodiments, the actuators are capable of tilting toilet seat 15 as it lifts and lowers, as shown in FIGS. 6*c* and 6*d*. The actuators can tilt the toilet seat at any angle 82, such as about 30-90 degrees as shown in FIG. 6*e*. Thus, the actuator can tilt the toilet seat at an angle of at least about (or no more than about) 30, 35, 40, 45, 50, 55, 60, 65, 70, 75, 80, 85 or 90 degrees. However, the presently disclosed subject matter is not limited and angle 82 can be any desired angle.

Figure 7A:
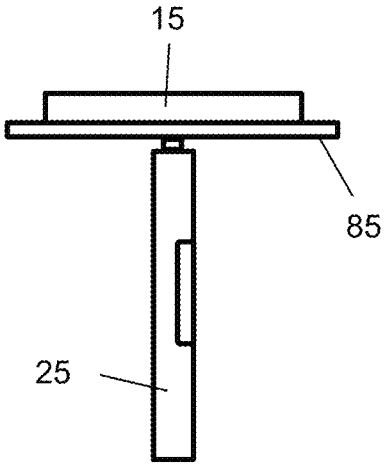
FIG. 7*a* is a side plan view of an actuator-toilet seat assembly in accordance with some embodiments of the presently disclosed subject matter.

Actuators 25 can be attached to directly to the bottom surface of toilet seat 15 using any desired method (e.g., clips, screws, bolts, and the like). However, in some embodiments, base 85 provides an attachment element for the actuators, as shown in FIG. 7*a*. Particularly, the bottom surface of the toilet seat can be permanently or releasably attached to base 85 using known methods. The base provides an attachment surface for actuator arm 80 and provides increased stability. Base 85 can have any desired shape or size.

Figure 7B:
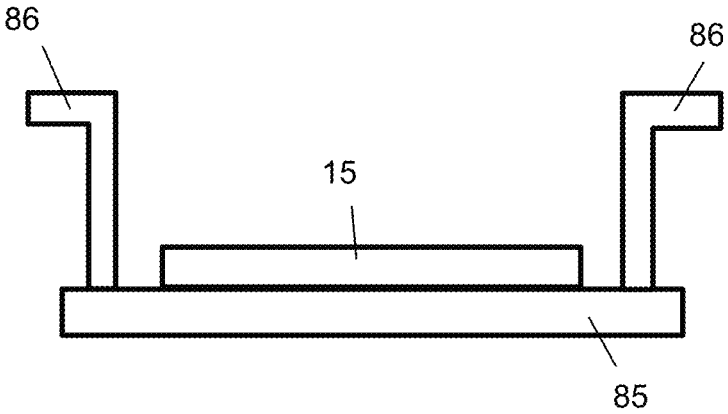
FIG. 7*b* is a front plan view of a toilet seat base comprising hand supports in accordance with some embodiments of the presently disclosed subject matter.

The base can optionally include one or more armrests 86 to provide additional support for the patient. For example, the patient can grasp the armrests while the actuator arms are being raised or lowered. One embodiment of armrests 86 is illustrated in FIG. 7*b*. However, it should be appreciated that the size and shape of armrests 86 are not limited.

Figure 8A:
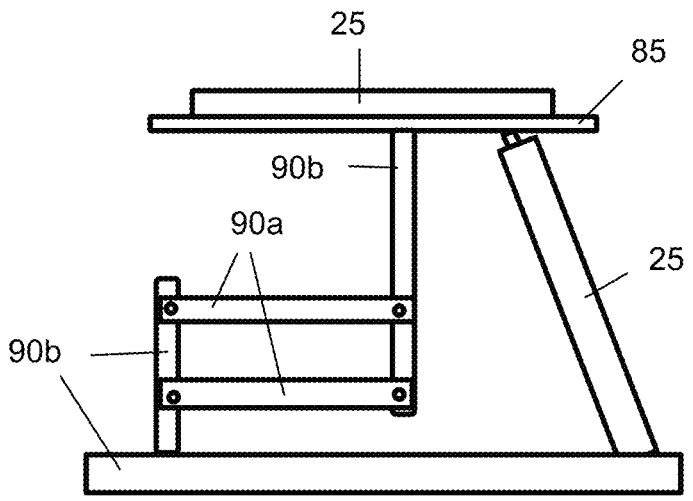
FIG. 8*a* is a side plan view of a toilet seat-actuator assembly in accordance with some embodiments of the presently disclosed subject matter.
Figure 8B:
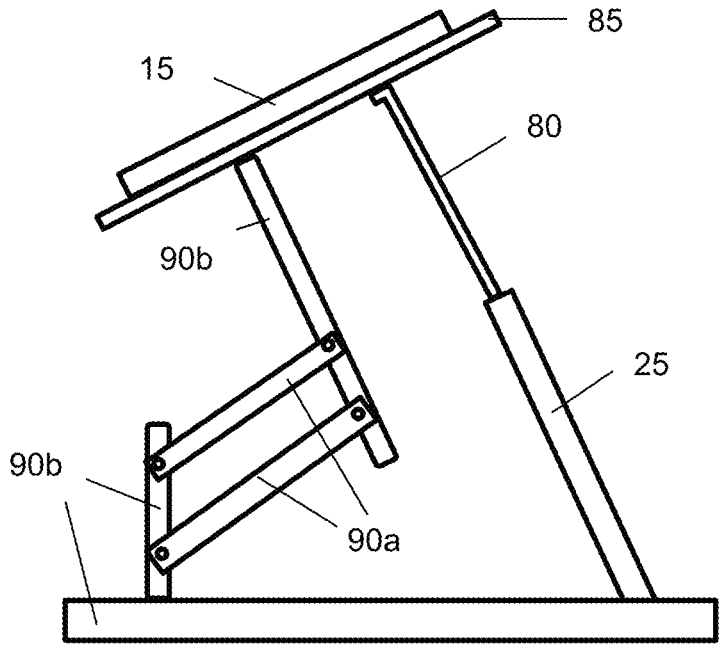
FIG. 8*b* is a side plan view of the toilet seat-actuator assembly of FIG. 8*a* in use in accordance with some embodiments of the presently disclosed subject matter.

In some embodiments, the actuator arm and weight of the patient are supported by one or more linkages 90. The linkages are attached to the base for raising and lowering the toilet seat, as well as tilting the seat such that the rear portion of the toilet seat is higher than the front portion. At least one of the support arms is capable of moving in response to the lifting of actuator arm 80. For example, as shown in FIGS. 8*a* and 8*b*, support arms 90*a* can rotate about stationary arms 90*b* in response to the lifting and lowering of actuator arm 80. Thus, the support arms can pivot about a joint. The tilt of toilet seat 15 occurs gradually throughout the raising of the seat. Specifically, the actuator raises the end portion of seat 15. As actuator arm 80 is raised, support arms 90*a* pivot about stationary arms 90*b*. In this way, the toilet seat and the user are fully reinforced during the entire lifting and lowering action.

Actuators 25 can be activated using any known mechanism, such as a foot pedal configured on the walker. Alternatively or in addition, a switch on the walker can be activated, or a remote control used.

Figure 9:
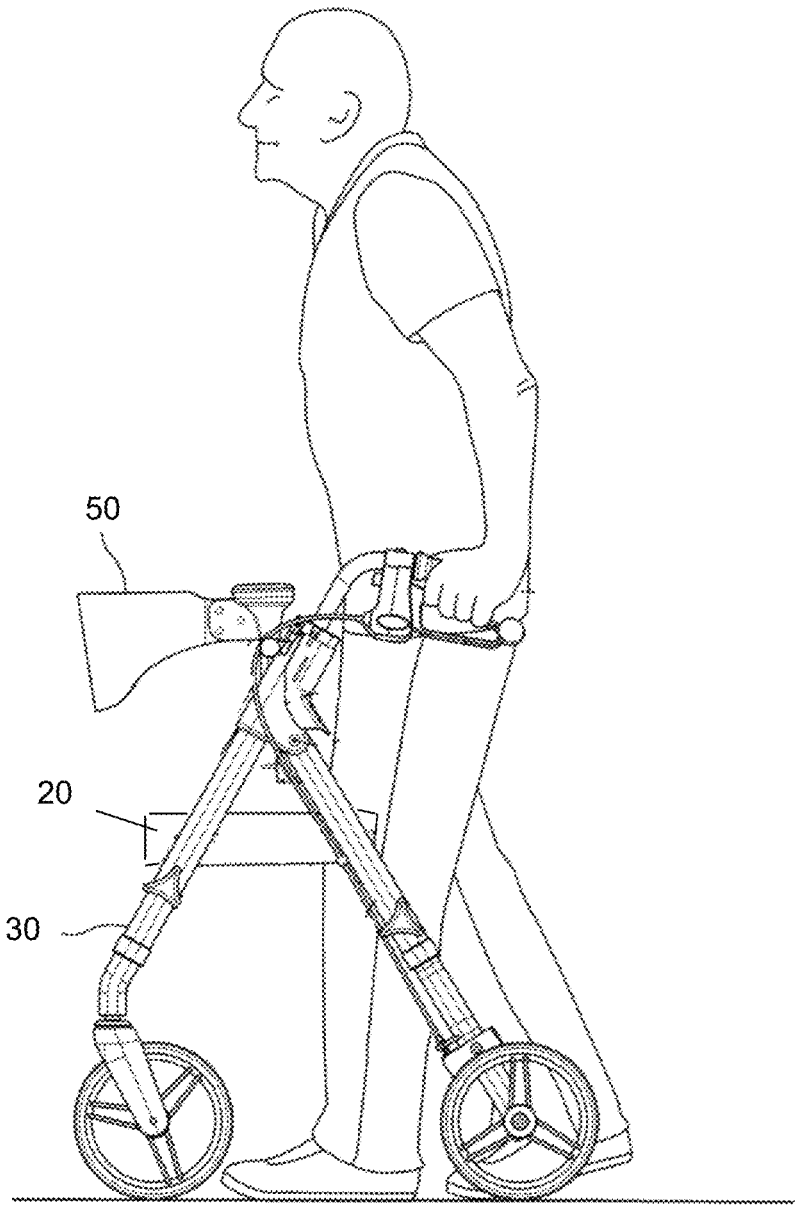
FIG. 9 is a side plan view of the disclosed walker in use in accordance with some embodiments of the presently disclosed subject matter.
Figure 10:
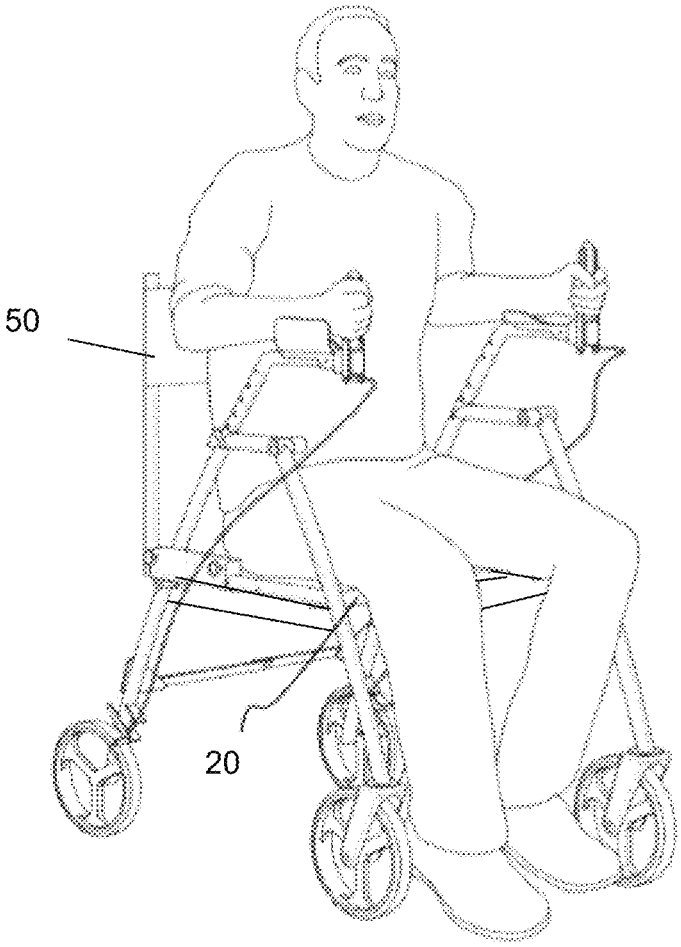
FIG. 10 is a perspective view of the disclosed walker in use in accordance with some embodiments of the presently disclosed subject matter.

In operation, a user can operate walker 5 to support their body while walking as shown in FIG. 9. The user can use the frame of the walker and/or handles 55 to bear at least a portion of his weight when moving from a first location to a second location. In some embodiments, the walker can function as a sitting surface, such as for resting before or after walking as shown in FIG. 10. Specifically, the user can sit on padded cover 20, with his back resting against backrest 50. When the walker is in use for walking or sitting, toilet seat 15 is hidden from view by cover 20.

When the patient needs to use the restroom, the walker is positioned such that cover 20 is above the toilet. The cover can be flipped up or removed to expose toilet seat 15 directly underneath. The user then backs up to contact toilet seat 15 of the walker, either with assistance or under their own control until their upper thigh contacts the forward section of the toilet seat. Actuators 25 can be initiated to raise and tilt up the toilet seat such that the user can simply lean back against the seat. The actuators can then lower the seat to the proper position over a toilet to allow the user to use the bathroom. After the patient has used the bathroom, actuators 25 can again be activated to lift and tilt the toilet seat, gradually bringing the user to a standing position, or to be seated on walker 5. The tilt of the seat assists the user to transfer the user's weight to their legs.

Figure 11A:
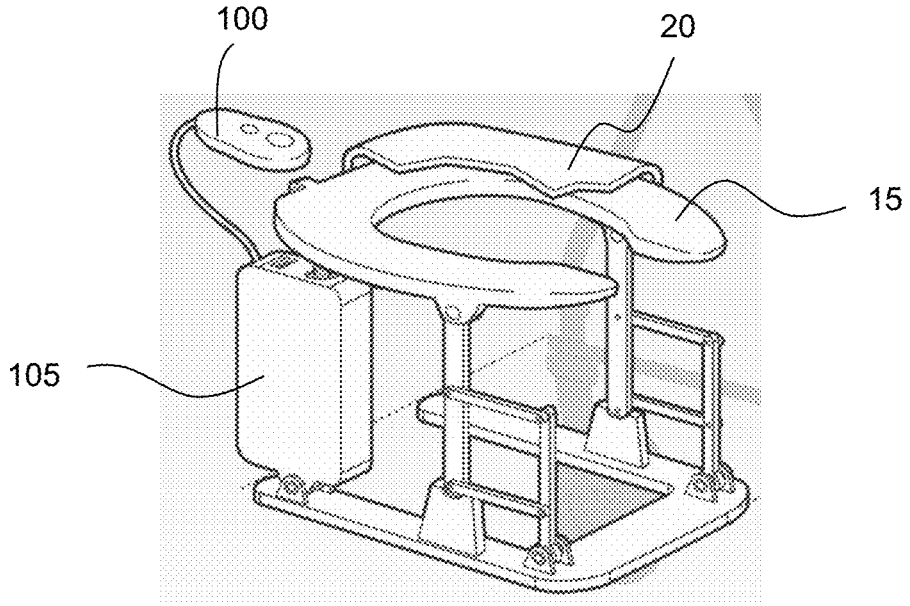
FIGS. 11*a*-11*d* are side plan views of one embodiment of using the walker in accordance with some embodiments of the presently disclosed subject matter.
Figure 11B:
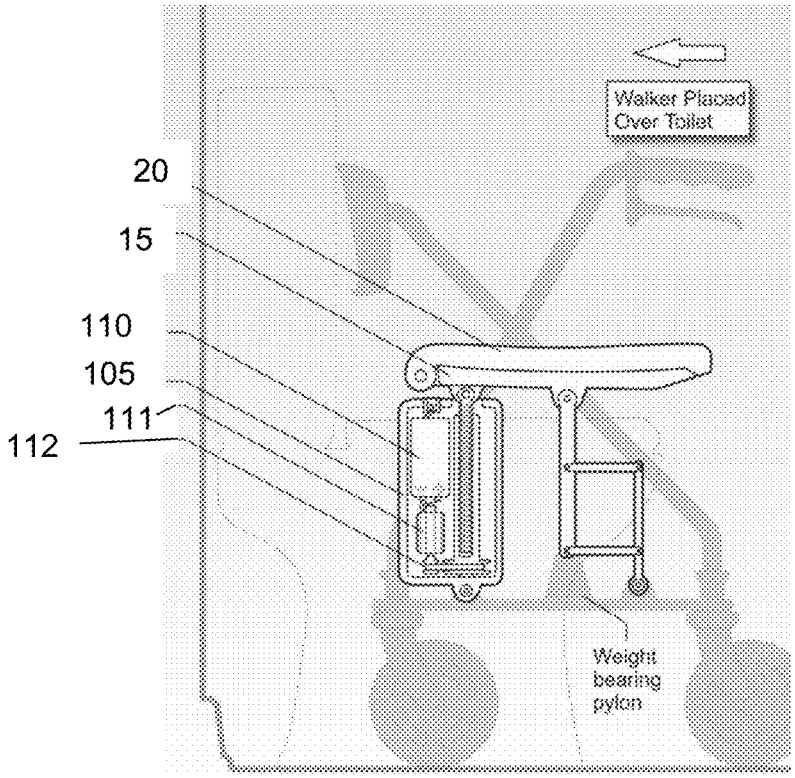
Figure 11C:
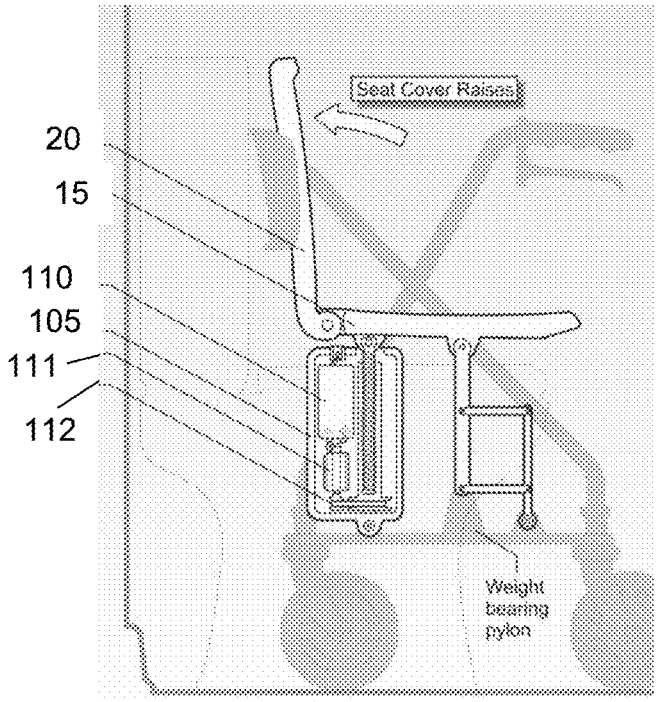
Figure 11D:
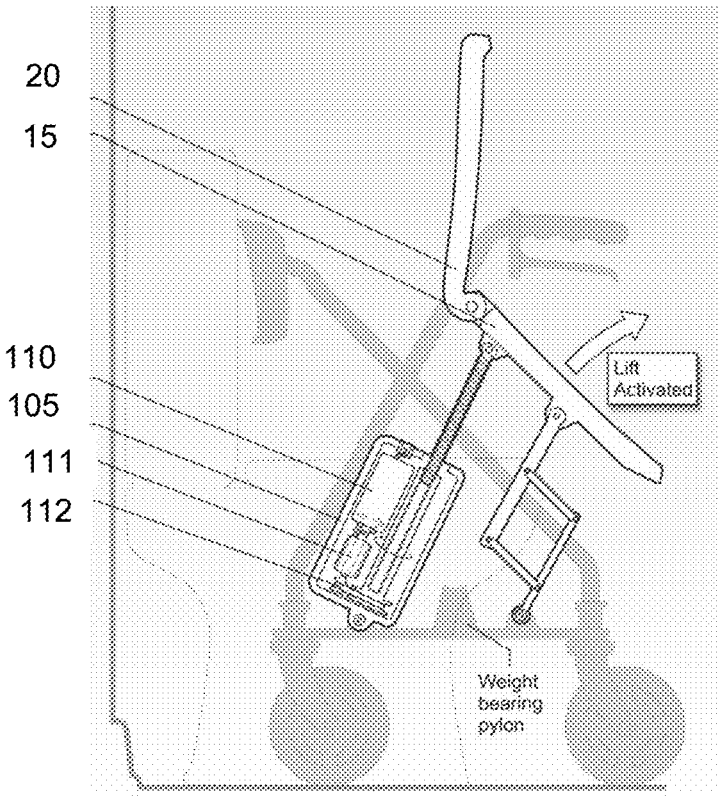

As shown below in FIG. 11*a*, the walker can include remote control 100 to lower and raise the seat as the user desires. Lift housing 105 can be configured in any desired way. As shown in FIG. 11*b*, the lift housing can include battery 110 (e.g., a rechargeable battery), lift drive 111, and motor 112. The walker can be placed directly over a toilet. In some embodiments, the walker includes a toilet seat as described above. In other embodiments, the walker can include a seat without a central aperture (e.g., a conventional seat). The seat can include a cover that is raised via a hinge or other mechanism to expose the sitting surface (which may or may not be a toilet seat) as shown in FIG. 11*c*. The seat can be activated to lift the seat to a raised position, as shown in FIG. 11*d*.

The walker as described herein includes many advantages over prior art walkers. For example, walker 5 is convenient and can be easily folded for packing, storing, and transporting.

By incorporating toilet seat 15 into the walker, the user can confidently know that he or she can use the toilet anywhere at any time.

Advantageously, the walker provides freedom and increased dignity by allowing a user with limited mobility to use the restroom on their own.

The device increases mobility in the user and prevents back injuries to care givers.

Because the walker can be easily relocated after use, the construction of walker 5 does not interfere with use of the toilet by a non-invalid user, nor does it hinder cleaning of the toilet bowl.

Walker 5 is also structurally simple and easy to construct.

As described above, although several embodiments of the present invention has been described for illustrative purposes, those skilled in the art will appreciate that various modifications, additions, and substitutions are possible without departing from the scope and spirit of the invention as disclosed in the accompanying claims.

What is claimed is:

1. A walker comprising:

a structural frame;

a seat assembly comprising:

a removable cover defined by a top surface and an interior; and a toilet seat positioned within the interior of the cover, wherein the toilet seat is hidden from view;

a pair of actuators functionally attached to the toilet seat, wherein each actuator comprises an arm that raises or lowers the toilet seat on demand.

2. The walker of claim 1, wherein the frame comprises:
a pair of front legs;
a pair of rear legs;
a backrest;
a pair of handles to guide the path of the walker; and
a pair of brakes, each brake positioned adjacent to one of the handles.

3. The walker of claim 2, wherein the frame further comprises a wheel positioned at one end of each of the front legs, each of the rear legs, or both.

4. The walker of claim 1, wherein the frame is foldable.

5. The walker of claim 1, wherein the toilet seat is releasably attached to the frame.

6. The walker of claim 1, wherein the cover is pivotable about the frame or removable from the frame.

7. The walker of claim 1, wherein the actuator comprises a hydraulic drive, pneumatic drive, gear drive, electric drive, motor drive, ion drive, gravity drive, threaded spindle drives, piezoelectric drive, recoil drive, gas spring, linear actuator, solenoids, pistons, or combinations thereof.

8. The walker of claim 1, wherein the actuators are each powered by a rechargeable battery.

9. The walker of claim 1, wherein the actuator arm can raise vertically or can raise at an angle to tilt the toilet seat.

10. The walker of claim 9, wherein the toilet seat is tilted at an angle of about 30-85 degrees.

11. The walker of claim 9, wherein the toilet seat is tilted such that a back end of the toilet seat is higher than a front end of the toilet seat.

12. The walker of claim 1, wherein the actuator is attached to a base positioned on a lower face of the toilet seat.

13. The walker of claim 1, further comprising one or more support arms that move in response to the raising of the actuator arm.

14. A method of lowering a user onto a toilet and raising the user from the toilet on demand, the method comprising:
positioning a walker adjacent to a toilet, such that the walker toilet seat is above the actual toilet seat, wherein the walker comprises:
a structural frame;
a seat assembly comprising: a removable cover defined by a top surface and an interior; and a toilet seat positioned within the interior of the cover, wherein the toilet seat is hidden from view;
a pair of actuators functionally attached to the toilet seat, wherein each actuator comprises an arm that raises or lowers the toilet seat on demand;
removing or pivoting the cover to expose the toilet seat;
positioning the user adjacent to the cover seat such that the rear face of the user contacts the toilet;
initiating the actuators to raise the toilet seat level with the user such that the user can contact the toilet seat;
lowering the actuator arm to lower the user onto the toilet;
when desired by the user, initiating the actuator arms to raise the toilet seat, whereby the toilet seat is tilted to raise the user to a standing position.

15. The method of claim 14, wherein the actuator comprises a hydraulic drive, pneumatic drive, gear drive, electric drive, motor drive, ion drive, gravity drive, threaded spindle drives, piezoelectric drive, recoil drive, gas spring, linear actuator, solenoids, pistons, or combinations thereof.

16. The method of claim 14, wherein the actuator arm can raise vertically or can raise at an angle to tilt the toilet seat.

17. The method of claim 14, wherein the toilet seat is tilted at an angle of about 30-85 degrees.

18. The method of claim 14, wherein the toilet seat is tilted such that a back end of the toilet seat is higher than a front end of the toilet seat.

19. The method of claim 14, wherein the walker further comprises one or more support arms that move in response to the raising of the actuator arm.

20. The method of claim 14, wherein the actuators are each powered by a rechargeable battery.

* * * * *